US010513787B2

(12) United States Patent
Haneda et al.

(10) Patent No.: US 10,513,787 B2
(45) Date of Patent: Dec. 24, 2019

(54) ELECTRODE FOR ELECTROLYSIS, ELECTROLYTIC CELL AND PRODUCTION METHOD FOR ELECTRODE FOR ELECTROLYSIS

(75) Inventors: Tsuyoshi Haneda, Tokyo (JP); Kazuyuki Tsuchida, Tokyo (JP); Toshinori Hachiya, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 16 days.

(21) Appl. No.: 13/993,860

(22) PCT Filed: Dec. 14, 2011

(86) PCT No.: PCT/JP2011/078952

§ 371 (c)(1),
(2), (4) Date: Aug. 27, 2013

(87) PCT Pub. No.: WO2012/081635

PCT Pub. Date: Jun. 21, 2012

(65) Prior Publication Data

US 2013/0334037 A1 Dec. 19, 2013

(30) Foreign Application Priority Data

Dec. 15, 2010 (JP) ..... 2010-279634

(51) Int. Cl.

| | |
|---|---|
| ***C25B 11/08*** | (2006.01) |
| ***C25B 11/04*** | (2006.01) |
| ***C25B 1/26*** | (2006.01) |

(52) U.S. Cl.

CPC ..... *C25B 11/0405* (2013.01); *C25B 1/26* (2013.01); *C25B 11/0484* (2013.01); *C25B 11/0494* (2013.01)

(58) Field of Classification Search

CPC . C25B 11/04; C25B 11/0405; C25B 11/0442; C25B 11/0478; C25B 11/0484;

(Continued)

(56) References Cited

U.S. PATENT DOCUMENTS 4,233,340 A * 11/1980 Saito ..... C25B 11/0484 427/125
4,313,814 A * 2/1982 Saito ..... C25B 11/0478 204/290.12
5,948,223 A 9/1999 Horikoshi et al.

FOREIGN PATENT DOCUMENTS

JP S45-011014 4/1970
JP S45-011015 4/1970

(Continued)

OTHER PUBLICATIONS

Tsuchida et al (Machine translation of JP 2010-059446, referred to as Tscuchida 446).*

(Continued)

*Primary Examiner* — Alexander W Keeling
(74) *Attorney, Agent, or Firm* — Greenblum & Bernstein, P.L.C.

(57) ABSTRACT

An electrode for electrolysis includes a conductive substrate, a first layer formed on the conductive substrate, and a second layer formed on the first layer. The first layer contains at least one oxide selected from the group consisting of ruthenium oxide, iridium oxide, and titanium oxide. The second layer contains an alloy of platinum and palladium. The electrode for electrolysis shows low overvoltage and has excellent durability over a long period.

14 Claims, 9 Drawing Sheets

(58) Field of Classification Search
CPC ..... C25B 11/0494; C02F 1/46109; C02F 2001/46133; C02F 2001/46138; C02F 2001/46142
USPC .... 204/280, 290.01, 290.03, 290.12, 290.14, 204/290.08–290.09
See application file for complete search history.

(56) References Cited

FOREIGN PATENT DOCUMENTS

| | | |
|---|---|---|
| JP | S52-068076 | 6/1977 |
| JP | S53-093179 | 8/1978 |
| JP | S54-043879 | 4/1979 |
| JP | 2003-041390 | 2/2003 |
| JP | 2010-059446 | 3/2010 |
| JP | 2010-065311 | 3/2010 |
| JP | 2010065311 A * | 3/2010 |

OTHER PUBLICATIONS

Tsuchida et al (Machine translation of JP 2010-065311, referred to as Tscuchida 311).*
Office Action in counterpart Taiwanese Application No. 100146562, dated Feb. 14, 2014.
International Preliminary Report on Patentability in counterpart Int'l Application No. PCT/JP2011/078952, dated Jun. 27, 2013.
Supplementary Search Report in counterpart European Application No. EP11849115.8, dated Jan. 20, 2014.
Yi et al., "Effect of $IrO_2$ loading on $RuO_2$—$IrO_2$—$TiO_2$ anodes: A study of microstructures and working life for the chlorine evolution reaction," Ceramics International, 33 (2007), pp. 1087-1091 (available online Jul. 18, 2006).

* cited by examiner

ELECTRODE FOR ELECTROLYSIS, ELECTROLYTIC CELL AND PRODUCTION METHOD FOR ELECTRODE FOR ELECTROLYSIS

TECHNICAL FIELD

The present invention relates to an electrode for electrolysis, an electrolytic cell, and a production method for an electrode for electrolysis.

BACKGROUND ART

An ion-exchange membrane method brine electrolysis is a method for producing caustic soda, chlorine, and hydrogen by the electrolyzing (electrolysis) of brine with electrodes for electrolysis. In an ion-exchange membrane method brine process, a technique that can maintain a low electrolysis voltage over a long period of time in order to cut the amount of power consumption is desired. An electrolysis voltage includes a voltage caused by resistance of an ion-exchange membrane or structural resistance of an electrolytic cell, overvoltage of an anode and a cathode, voltage caused by the distance between an anode and a cathode, or the like, in addition to a voltage that is theoretically necessary. It is known that, when electrolysis is continued for a long period of time, the voltage rises based on various reasons such as impurities in the brine.

Conventionally, electrodes called Dimension Stable (DSA) (Permelec Electrode Ltd., registered trademark) have been widely used as anodes (electrodes for electrolysis) for chlorine evolution. The DSA (registered trademark) is an insoluble electrode in which a coating of an oxide of a platinum group metal such as ruthenium is provided on a titanium substrate.

Among the platinum group metals, palladium in particular has properties of low chlorine overvoltage and high oxygen overvoltage and is therefore known as a catalyst ideal for the evolution of chlorine in an ion-exchange membrane method brine electrolysis. An electrode using palladium shows lower chlorine overvoltage than the DSA (registered trademark) and has excellent properties such as low oxygen gas concentration within chlorine gas.

As specific examples of the anode described above, Patent Literatures 1 to 3 shown below disclose an electrode for electrolysis formed of an alloy of platinum and palladium. Patent Literature 4 shown below discloses an electrode in which a coating formed of palladium oxide and platinum metal or of palladium oxide and a platinum-palladium alloy is formed by thermal decomposition on a titanium substrate. Patent Literature 5 shown below discloses a production method for an electrode where a solution in which palladium oxide powder together with a salt of a platinum compound is dispersed is applied onto a conductive substrate and then thermally decomposed. Patent Literature 6 shown below discloses an electrode in which a first coating layer formed of platinum or the like is provided on a substrate and then a second coating layer formed of palladium oxide and tin oxide is formed by thermal decomposition.

CITATION LIST

Patent Literature

[Patent Literature 1] Japanese Examined Patent Application Publication No. S45-11014

[Patent Literature 2] Japanese Examined Patent Application Publication No. S45-11015

[Patent Literature 3] Japanese Examined Patent Application Publication No. S48-3954

[Patent Literature 4] Japanese Unexamined Patent Application Publication No. S53-93179

[Patent Literature 5] Japanese Unexamined Patent Application Publication No. S54-43879

[Patent Literature 6] Japanese Unexamined Patent Application Publication No. S52-68076

SUMMARY OF INVENTION

Technical Problem

However, with electrodes for chlorine evolution (electrode for electrolysis) described in Patent Literatures 1 to 3, there are cases where the overvoltage is high and the durability is low. There are also cases where production methods for electrodes described in Patent Literatures 2 and 3 are impractical due to a large number of steps. With an electrode described in Patent Literature 4, there are cases where the durability is low. With electrodes described in Patent Literatures 5 and 6, there are cases where the mechanical strength is low and the industrial productivity is low. As described above, it is conventionally difficult to provide long-term durability to an electrode for electrolysis with low overvoltage in which excellent catalytic properties of palladium is utilized and also difficult to produce an electrode for electrolysis having both low overvoltage and long-term durability with high industrial productivity.

Thus, it is an object of the present invention to provide an electrode for electrolysis that shows low overvoltage and has excellent durability, a production method for the same, and an electrolytic cell including the electrode for electrolysis.

Solution to Problem

An electrode for electrolysis according to the present invention includes a first layer formed on a conductive substrate and a second layer formed on the first layer, wherein the first layer contains at least one oxide selected from the group consisting of ruthenium oxide, iridium oxide, and titanium oxide, and the second layer contains an alloy of platinum and palladium.

The electrode for electrolysis of the present invention described above shows low overvoltage (chlorine overvoltage) and excellent durability in the case of use as an anode for chlorine evolution in an ion-exchange membrane method brine electrolysis, for example. Such an electrode for electrolysis shows low overvoltage for a long period of time. Thus, in the present invention, excellent catalytic properties in a chlorine evolution reaction are maintained for a long period of time. As a result, in the present invention, it is possible to decrease the oxygen gas concentration within generated chlorine gas and produce chlorine gas of high purity over a long period.

The second layer preferably further contains palladium oxide.

Due to the second layer containing palladium oxide, the chlorine overvoltage immediately after electrolysis can further be decreased. In the case of an electrode for electrolysis without containing palladium oxide, the overvoltage from immediately after the start of electrolysis until activation of the alloy of platinum and palladium is high compared to a case where palladium oxide is contained. By contrast due to the second layer containing palladium oxide, low overvoltage can be maintained also from the initial period of electrolysis until activation of the alloy of platinum and palladium.

A half width of a diffraction peak of the alloy described above of which a diffraction angle is 46.29° to 46.71° in a powder X-ray diffraction pattern is preferably 1° or less.

The half width of the diffraction peak of the alloy of platinum and palladium being 1° or less shows that the crystallinity and the stability of the alloy of platinum and palladium is high. By causing such an alloy to be contained in the second layer, the durability of the electrode for electrolysis can further be increased.

A content of platinum element contained in the second layer is preferably from 1 to 20 mol with respect to 1 mol of palladium element contained in the second layer.

Due to the content of platinum element contained in the second layer being in a range described above, the alloy of platinum and palladium is more easily formed, and the durability of the electrode for electrolysis can further be increased. The utilization of palladium as a catalyst can be held at an appropriate value to more easily decrease the overvoltage and the electrolysis voltage of the electrode for electrolysis.

The first layer described above preferably contains ruthenium oxide, iridium oxide, and titanium oxide. The content of iridium oxide contained in the first layer is preferably ⅕ to 3 mol with respect to 1 mol of ruthenium oxide contained in the first layer, and the content of titanium oxide contained in the first layer is preferably ⅓ to 8 mol with respect to 1 mol of ruthenium oxide contained in the first layer. Due to the first layer including such a composition, the durability of the electrode increases further.

The present invention also provides an electrolytic cell including the electrode for electrolysis of the present invention described above.

Since the electrolytic cell of the present invention described above has the electrode for electrolysis having low overvoltage (chlorine overvoltage) and excellent durability, it is possible to produce chlorine gas of high purity over a long time in the case where brine is electrolyzed by ion-exchange membrane method brine electrolysis in the electrolytic cell.

The present invention also provides a production method for an electrode for electrolysis, including a step of baking, under presence of oxygen, of a coating film formed through application of a solution containing at least one compound selected from the group consisting of ruthenium compound, iridium compound, and titanium compound onto a conductive substrate to form a first layer, and a step of baking, under presence of oxygen, of a coating film formed through application of a solution containing a platinum compound and a palladium compound onto the first layer to form a second layer.

With the production method of the present invention described above, the electrode for electrolysis of the present invention described above can be produced.

In the production method of the present invention described above, it is preferable that the platinum compound should be platinum nitrate salt, and the palladium compound should be palladium nitrate.

Using the palladium nitrate and platinum nitrate salt enables the concentration of a coating solution to be increased and the second layer that is even and high in coverage to be formed even if the number of times of application is decreased. Furthermore, the half width of the diffraction peak of the alloy of platinum and palladium can further be narrowed to produce an electrode for electrolysis with higher durability.

Advantageous Effects of Invention

With the present invention, an electrode for electrolysis that shows low overvoltage and has excellent durability, a production method for the same, and an electrolytic cell including the electrode for electrolysis can be provided.

DESCRIPTION OF EMBODIMENTS

Figure 1:
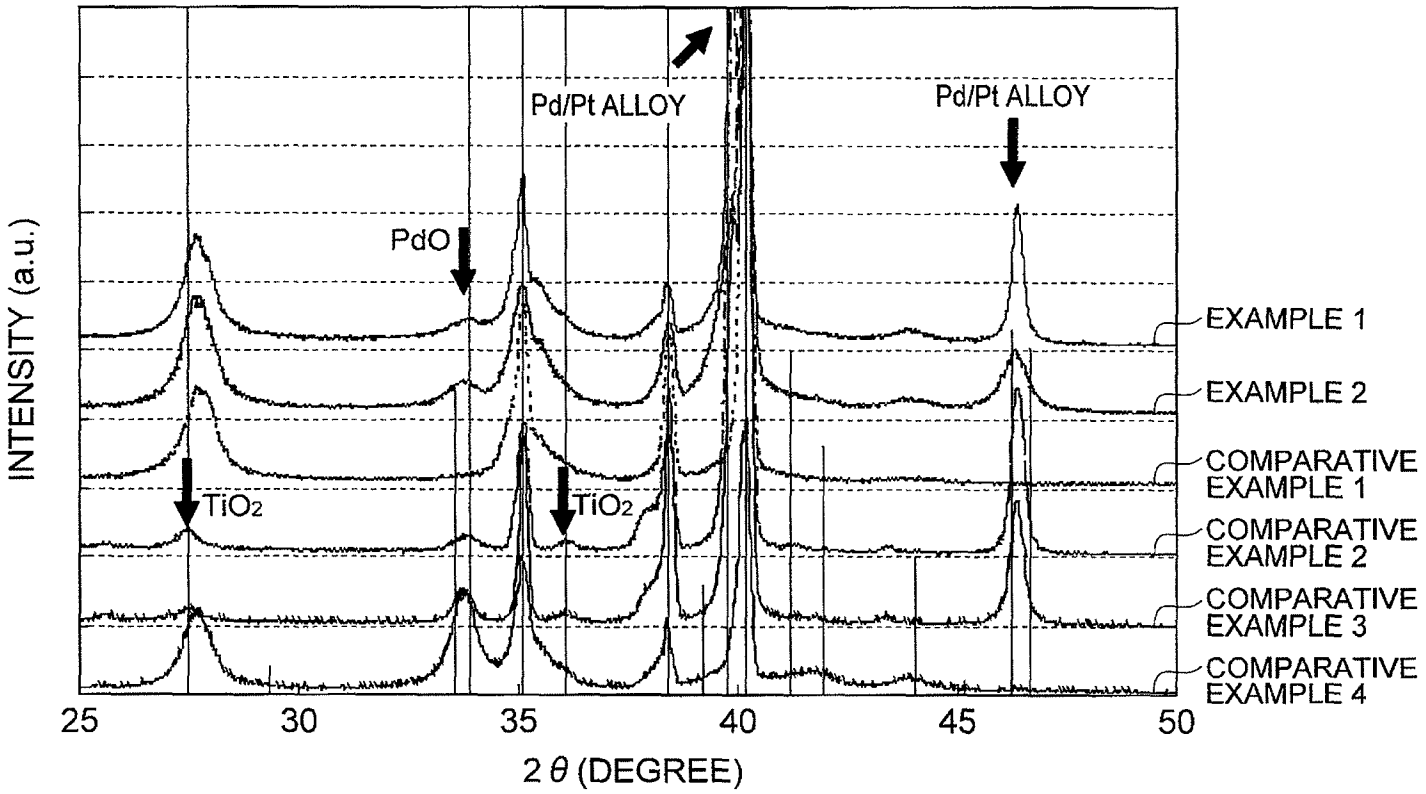
FIG. 1 is a graph (diffraction pattern) of a powder X-ray diffraction measurement result for an electrode for electrolysis of each example and comparative example.

One preferable embodiment of the present invention will be described below in detail with reference to the drawings. Note that the present invention is not limited to the embodiment shown below. Note that, in the drawings, the same components are denoted by the same reference signs, and the reference signs for the same components are partly omitted. The drawings are illustrated partially with exaggeration for a better understanding, and the dimension ratio does not necessarily coincide with what is described.

Figure 4:
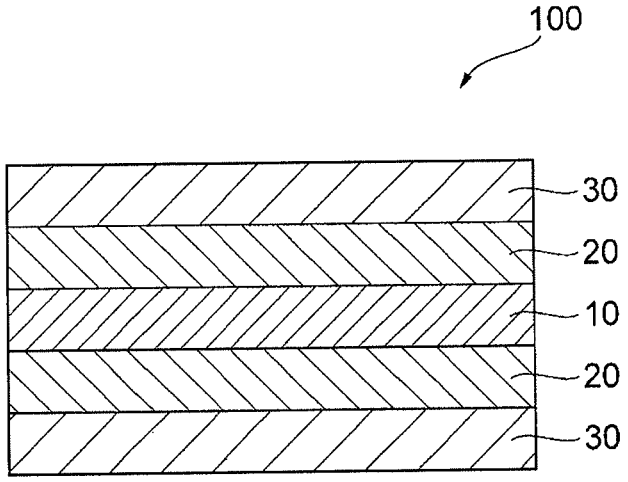
FIG. 4 is a schematic sectional view of an electrode for electrolysis according to one embodiment of the present invention.

As shown in FIG. 4, an electrode for electrolysis 100 according to this embodiment includes a conductive substrate 10, a pair of first layers 20 that coat both surfaces of the conductive substrate 10, and a pair of second layers 30 that coat the surfaces of the respective first layers 20. The first layer 20 preferably coats the entire conductive substrate 10, and the second layer 30 preferably coats the entire first layer 20. Accordingly, the catalytic activity and durability of the electrode increases easily. Note that the first layer 20 and the second layer 30 may be laminated only on one surface of the conductive substrate 10.

Conductive Substrate

Since the conductive substrate 10 is used in a chlorine gas evolution atmosphere within salt water of high concentration close to saturation, the material is preferably titanium of which the corrosion resistance is high. The shape of the conductive substrate 10 is not particularly limited, and a substrate of an expanded shape or a shape of a porous plate, metal mesh, or the like is suitably used. The thickness of the conductive substrate 10 is preferably 0.1 to 2 mm.

For the conductive substrate 10, a process of increasing the surface area is preferably performed in order to cause adhesion of the first layer 20 and the surface of the conductive substrate 10. Processes of increasing the surface area include a blasting process using cut wire, steel grit, alumina grit, or the like and acid treatment using sulfuric acid or hydrochloric acid. It is preferable to increase the surface area by performing the acid treatment after an irregularity is formed on the surface of the conductive substrate 10 by the blasting process.

First Layer

The first layer 20 that is a catalyst layer contains at least one oxide among ruthenium oxide, iridium oxide, and titanium oxide. Examples of ruthenium oxides include $RuO_2$. Examples of iridium oxides include $IrO_2$. Examples of titanium oxides include $TiO_2$. The first layer 20 preferably contains two types of oxides of ruthenium oxide and titanium oxide or contains three types of oxides of ruthenium oxide, iridium oxide, and titanium oxide. Accordingly, the first layer 20 becomes a more stable layer, and the adhesion with the second layer 30 increases more.

In the case where the first layer 20 contains two types of oxides of ruthenium oxide and titanium oxide, the titanium oxide contained in the first layer 20 is preferably 1 to 9 mol and more preferably 1 to 4 mol with respect to 1 mol of the ruthenium oxide contained in the first layer 20. By causing the composition ratio of the two types of oxides to be in this range, the electrode for electrolysis 100 shows excellent durability.

In the case where the first layer 20 contains three types of oxides of ruthenium oxide, iridium oxide, and titanium oxide, the iridium oxide contained in the first layer 20 is preferably ⅕ to 3 mol and more preferably ⅓ to 3 mol with respect to 1 mol of the ruthenium oxide contained in the first layer 20. The titanium oxide contained in the first layer 20 is preferably ⅓ to 8 mol and more preferably 1 to 8 mol with respect to 1 mol of ruthenium oxide contained in the first layer 20. By causing the composition ratio of the three types of oxides to be in this range, the electrode for electrolysis 100 shows excellent durability.

Aside from the composition described above, those of various compositions can be used as long as at least one oxide among ruthenium oxide, iridium oxide, and titanium oxide is contained. For example, it is also possible to use, as the first layer 20, an oxide coating that is called DSA (registered trademark) and contains ruthenium, iridium, tantalum, niobium, titanium, tin, cobalt, manganese, and platinum.

The first layer 20 does not need to be a single layer and may contain a plurality of layers. For example, the first layer 20 may contain a layer containing three types of oxides and another layer containing two types of oxides. The thickness of the first layer 20 is preferably 1 to 5 μm and more preferably 0.5 to 3 μm.

Second Layer

The second layer 30 that is a catalyst layer contains an alloy of platinum and palladium. In a powder X-ray diffraction pattern of the electrode for electrolysis 100, the half width (full width at half maximum) of a diffraction peak of the alloy of platinum and palladium of which the diffraction angle 2θ is 46.29° to 46.71° is preferably 1° or less, further preferably 0.7° or less, and particularly preferably 0.5° or less. The half width being 1° or less shows that the crystallite size of the alloy of platinum and palladium is large and the crystallinity is high and shows that the physical and chemical stability of the alloy is high. Thus, the elution amount of the catalyst, particularly palladium, from the electrode for electrolysis during electrolysis decreases, and the durability of the electrode increases. When the half width is 5° or less, the durability of the electrode for electrolysis increases tremendously. Note that, since the durability increases more with a lower half width, the lower limit, although not particularly limited, is preferably 0.01° or greater.

With the electrode for electrolysis 100, it is presumed that the overvoltage is decreased to exhibit catalytic activity by the valence of palladium becoming +2. Specifically, palladium within the alloy of platinum and palladium contained in the second layer 30 is gradually oxidized under anode atmosphere and becomes palladium with a valence of +2 that is catalytically active. As a result, it is presumed that the electrode for electrolysis 100 continues to maintain the catalytic activity.

Before conduction (at the start of brine electrolysis), the second layer 30 preferably further contains palladium oxide. Examples of palladium oxide include PdO.

Due to the second layer 30 containing palladium oxide, the chlorine overvoltage immediately after electrolysis can further be decreased. In the case of an electrode for electrolysis not containing palladium oxide, the overvoltage from immediately after the start of electrolysis until activation of the alloy of platinum and palladium is high compared to a case where palladium oxide is contained. By contrast, due to the second layer containing palladium oxide, low overvoltage can be maintained also from the initial period of electrolysis until activation of the alloy of platinum and palladium. Note that palladium oxide is reduced and gradually consumed when electrolysis is performed and therefore mostly not detected from the electrode for electrolysis after electrolysis.

The content of palladium oxide contained in the second layer 30 is preferably 0.1 to 20 mol % and more preferably 0.1 to 10 mol % with respect to the total amount of metal contained in the second layer 30. When the content of palladium oxide is 20 mol % or less, the durability of the electrode for electrolysis increases. The content of the alloy of platinum and palladium is preferably 80 mol % or greater and 99.1 mol % or less and more preferably 90 mol % or greater and 99.1 mol % or less with respect to the total amount of metal contained in the second layer 30. Within this range of content, the durability of the electrode for electrolysis increases more.

The palladium oxide contained in the second layer 30 is reduced during electrolysis to become metal palladium, reacts with a chloride ion ($Cl^-$) within brine, and is eluted as $PdCl_4^{2-}$. As a result, the durability of the electrode for electrolysis 100 decreases. In particular, when a shutdown operation of stopping chlorine evolution electrolysis is repeatedly performed, depletion (elution) of palladium becomes significant. That is, when the percentage of palladium oxide is too high, elution of palladium that is the catalyst increases, and the durability of the electrode for electrolysis 100 decreases. These problems are more easily prevented if the content of palladium oxide is within a numerical value range described above.

The content of palladium oxide contained in the second layer 30 can be confirmed with a peak position of the alloy of platinum and palladium in a powder X-ray diffraction measurement. Even in the case where the presence of palladium oxide in a minute amount can be confirmed by a powder X-ray diffraction measurement in the electrode for electrolysis 100 before performing electrolysis, there are cases where palladium oxide cannot be detected with a powder X-ray diffraction measurement for the electrode for electrolysis 100 after conduction for a long period of time. The reason for this is because a part of palladium derived from palladium oxide is eluted as described above. Note that the elution amount of the palladium is an extremely minute amount to an extent that the effect of the present invention is not inhibited.

The content of platinum element contained in the second layer 30 is preferably 1 to 20 mol with respect to 1 mol of palladium element contained in the second layer 30. When the content described above of platinum element is less than 1 mol, the alloy of platinum and palladium is less likely formed, palladium oxide is formed a lot, and a solid solution in which platinum is incorporated into palladium oxide is formed a lot. As a result, there are cases where the durability of the electrode for electrolysis 100 with respect to the shutdown operation described above decreases. When there is more than 20 mol, the amount of palladium within the alloy of platinum and palladium decreases, and the utilization of palladium as a catalyst decreases. Therefore, there are cases where the decreasing effects for the overvoltage and the electrolysis voltage decrease. Due to use of a large amount of expensive platinum, there are cases where it is not economically preferable. More preferably, it is greater than 4 mol and less than 10 mol. With the content of platinum element exceeding 4 mol, the half width of the alloy of platinum and palladium decreases more, and the crystallinity of the alloy increases more.

The second layer 30 is preferably 0.05 to 1 μm in thickness in terms of economy, although a larger thickness can lengthen the period in which the electrolysis performance can be maintained.

Relationship of First Layer and Second Layer

The second layer 30 is formed evenly due to the first layer 20 containing at least one oxide among ruthenium oxide, iridium oxide, and titanium oxide being present under the second layer 30 containing the alloy of platinum and palladium (and palladium oxide). Adhesion of the conductive substrate 10, the first layer 20, and the second layer 30 is high. Therefore, the electrode for electrolysis 100 shows excellent effects of being high in durability and low in overvoltage and electrolysis voltage.

Electrolytic Cell

Figure 5:
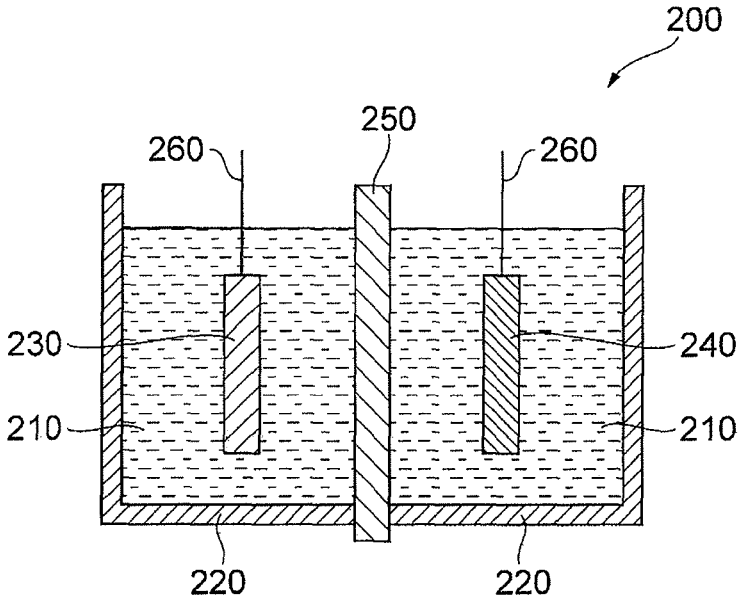
FIG. 5 is a schematic sectional view of an electrolytic cell according to one embodiment of the present invention.

An electrolytic cell of this embodiment has, as an anode, the electrode for electrolysis of the embodiment described above. FIG. 5 is a schematic sectional view of an electrolytic cell 200 according to this embodiment. The electrolytic cell 200 includes an electrolyte 210, a container 220 for accommodating the electrolyte 210, an anode 230 and a cathode 240 immersed in the electrolyte 210, an ion-exchange membrane 250, and wires 260 that connect the anode 230 and the cathode 240 to a power supply. Note that, in the electrolytic cell 200, space on the anode side separated by the ion-exchange membrane 250 is called an anode chamber, and the space on the cathode side a cathode chamber.

As the electrolyte 210, a sodium chloride aqueous solution (salt water) or potassium chloride aqueous solution for the anode chamber and sodium hydroxide aqueous solution, potassium hydroxide aqueous solution, or the like for the cathode chamber can be used, for example. As the anode, the electrode for electrolysis of the embodiment described above is used. As the ion-exchange membrane, fluorine resin membrane or the like having an ion-exchange group can be used, and "Aciplex" (registered trademark) F6801 (produced by Asahi Kasei Chemicals Corporation) or the like can be used, for example. As the cathode, a cathode for hydrogen evolution that is an electrode or the like in which a catalyst is applied on a conductive substrate is used. Specifically, a cathode or the like in which a coating of ruthenium oxide is formed on a metal mesh substrate formed of nickel can be given.

The electrode for electrolysis of the embodiment described above has a low chlorine overvoltage and high oxygen overvoltage and shows excellent catalytic properties in a chlorine evolution reaction. Thus, in the case where brine is electrolyzed by ion-exchange membrane method brine electrolysis using the electrolytic cell of this embodiment, the oxygen gas concentration within chlorine gas evolved at the anode can be decreased. That is, with the electrolytic cell of this embodiment, chlorine gas of high purity can be produced. Since it is possible to decrease the electrolysis voltage in brine electrolysis than before with the electrode for electrolysis of the embodiment described above, power consumption required for the brine electrolysis can be decreased with the electrolytic cell of this embodiment. Since the electrode for electrolysis of this embodiment described above contains a crystalline platinum-palladium alloy of high stability within the second layer, there is less elution of a catalytic component (particularly palladium) from the electrode, and the long-term durability is excellent. Thus, with the electrolytic cell of this embodiment, the catalytic activity of the electrode is maintained to be high over a long time, and it is possible to produce chlorine of high purity.

Production Method for Electrode for Electrolysis

Next, one embodiment of a production method for the electrode for electrolysis 100 will be described in detail. In this embodiment, the electrode for electrolysis 100 can be produced by forming the first layer 20 and the second layer 30 on a conductive substrate by baking (thermal decomposition) of a coating film under oxygen atmosphere. In such a production method of this embodiment, the number of steps is less than in a conventional production method, and high productivity for the electrode for electrolysis 100 can be achieved. Specifically, a catalyst layer is formed on a conductive substrate by an application step of applying a coating solution containing a catalyst, a dry step of drying the coating solution, and a thermal decomposition step of performing thermal decomposition. Herein, thermal decomposition means to heat a metal salt as a precursor to decompose metal or metal oxide into gaseous substance. Although decomposition products differ depending on the used metal type, type of salt, atmosphere in which thermal decomposition is performed, or the like, there is a tendency that, for many metals, an oxide is more easily formed in oxidizing atmosphere. In an industrial production process for electrodes for electrolysis, thermal decomposition is generally performed in air, and a metal oxide is formed in many cases.

Formation of First Layer

Application Step

The first layer 20 is obtained through application of a solution (first coating solution) in which at least one metal salt of ruthenium, iridium, and titanium is dissolved to a conductive substrate and thermal decomposition (baking) under the presence of oxygen. The content percentage of ruthenium, iridium, and titanium within the first coating solution is approximately equal to the first layer 20.

The metal salt may be a chloride salt, a nitrate, a sulfate, metal alkoxide, or any other form. While a solvent of the first coating solution can be selected in accordance with the type of metal salt, water, alcohol such as butanol, or the like can be used. As the solvent, water is preferable. The total metal concentration within the first coating solution in which the metal salt is dissolved is not particularly limited, but is preferably in a range of 10 to 150 g/L in view of the thickness of a coating film formed with one time of application.

As a method for applying the first coating solution onto the conductive substrate 10, a dip method in which the conductive substrate 10 is immersed in the first coating solution, a method in which the first coating solution is applied with a brush, a roll method in which a sponge roller impregnated with the first coating solution is used, an electrostatic application method in which the conductive substrate 10 and the first coating solution are electrically charged with opposite charges to perform spraying, or the like is used. Of these, the roll method or the electrostatic application method that is excellent in industrial productivity is preferable.

Dry Step, Thermal Decomposition Step

The first coating solution is applied to a conductive substrate 100, then dried at a temperature of 10 to 90° C., and thermally decomposed in a baking furnace heated to 300 to 650° C. The drying and thermal decomposition temperatures can be appropriately selected depending on the composition or solvent type of the first coating solution. The time for each occasion of thermal decomposition is preferably long, preferably 5 to 60 minutes and more preferably 10 to 30 minutes in terms of productivity of the electrode.

A cycle of application, drying, and thermal decomposition described above is repeated to form a coating (first layer 20) of a predetermined thickness. When post baking that is baking for a long time is further performed according to necessity after the first layer 20 is formed, the stability of the first layer 20 can further be increased.

Formation of Second Layer

The second layer 30 is obtained through application of a solution (second coating solution) containing a palladium compound and a platinum compound onto the first layer 20 and thermal decomposition under the presence of oxygen. In the formation of the second layer, the second layer 30 containing the alloy of platinum and palladium and palladium oxide in an appropriate quantitative ratio can be obtained by selecting a thermal decomposition method. Although palladium oxide is consumed (eluted) in chlorine evolution electrolysis as described above, the electrode for electrolysis 100 has excellent durability as long as the amount of palladium oxide contained in the second layer 30 is appropriate, since the alloy of platinum and palladium is stable.

Application Step

As the palladium compound and the platinum compound that are dissolved and dispersed in the second coating solution for use as a catalyst precursor, a nitrate, a chloride salt, or any other form is acceptable, but use of a nitrate is preferable since an even coating layer (second layer 30) is formed easily at the time of thermal decomposition and the alloy of platinum and palladium is more easily formed. Nitrates of palladium include palladium nitrate and tetraamminepalladium(II) nitrate, and nitrates of platinum include dinitrodiammine platinum nitrate and tetraammineplatinum (II) nitrate. Using a nitrate enables the concentration of the second coating solution to be increased and the second layer 30 that is even and high in coverage to be obtained even if the number of times of application is decreased. The coverage is preferably 90% or greater and 100% or less. Furthermore, by using a nitrate, the half width of a diffraction peak of the alloy of platinum and palladium can be narrowed, and crystallinity of the alloy of platinum and palladium can be increased sufficiently. As a result, the durability of the electrode for electrolysis 100 increases more. In contrast, in the case where a chloride salt is used for the second coating solution, aggregation occurs when the concentration of the second coating solution is high, and there are cases where it is difficult to obtain the second layer 30 that is even and high in coverage.

While a solvent of the second coating solution can be selected in accordance with the type of metal salt, water, alcohol such as butanol, or the like can be used, and water is preferable. The total metal concentration within the second coating solution in which the palladium compound and the platinum compound are dissolved is not particularly limited, but is preferably 10 to 150 g/L and more preferably 50 to 100 g/L in view of the thickness of a coating film formed with one time of application.

As a method for applying the second coating solution containing the palladium compound and the platinum compound, a dip method in which the conductive substrate 10 having the first layer 20 is immersed in the second coating solution, a method in which the second coating solution is applied with a brush, a roll method in which a sponge roller impregnated with the second coating solution is used, an electrostatic application method in which the conductive substrate 10 having the first layer 20 and the second coating solution are electrically charged with opposite charges to perform atomization using a spray or the like, or the like is used. Of these, the roll method or the electrostatic application method that is excellent in industrial productivity is preferable.

Dry Step, Thermal Decomposition Step

The second coating solution is applied onto the first layer 20, then dried at a temperature of 10 to 90° C., and thermally decomposed in a baking furnace heated to 400 to 650° C. To form a coating layer (second layer 30) containing the alloy of platinum and palladium, thermal decomposition under an atmosphere containing oxygen is necessary. Normally, in an industrial production process for electrodes for electrolysis, thermal decomposition is performed in air. In this embodiment as well, the range of oxygen concentration is not particularly limited, and performing in air suffices. However, air may be distributed within the baking furnace to supply oxygen according to necessity.

The temperature of thermal decomposition is preferably 400 to 650° C. At below 400° C., decomposition of the palladium compound and the platinum compound is insufficient, and there are cases where the alloy of platinum and palladium is not obtained. At over 650° C., there are cases where the adhesion at the boundary of the first layer 20 and the conductive substrate 10 decreases because the conductive substrate of titanium or the like undergoes oxidation. The time for each occasion of thermal decomposition is preferably long, preferably 5 to 60 minutes and more preferably 10 to 30 minutes in terms of productivity of the electrode.

A cycle of application, drying, and thermal decomposition described above is repeated to form a coating (second layer 30) of a predetermined thickness. After the coating is formed, postheating that is baking for a long time can be performed to further increase the stability of the second layer 30. The temperature of postheating is preferably 500 to 650° C. The time for the postheating is preferably 30 minutes to 4 hours and more preferably 30 minutes to 1 hour. By performing postheating, the half width of a diffraction peak of palladium and platinum decreases more, and the crystallinity of the alloy of platinum and palladium can be increased sufficiently.

When a coating of a platinum group metal is formed directly on the surface of the conductive substrate formed of titanium, there are cases where titanium oxide is generated on the surface of the conductive substrate at the time of thermal decomposition and the adhesion of a coating layer of the platinum group metal and the conductive substrate decreases. In addition, in the case where the coating layer of the platinum group metal is formed directly on the conductive substrate, there are cases where a passivation phenomenon of the conductive substrate that occurs upon electrolysis does not allow use as an anode.

In contrast, with the electrode for electrolysis 100 of this embodiment, adhesion of the conductive substrate 10 and a catalyst layer (first layer 20 and second layer 30) can be increased and aggregation of a catalytic substance contained in the second layer 30 or the second layer 30 becoming an uneven layer can be prevented by the first layer 20 being formed on the conductive substrate 10 and the second layer 30 being formed thereon.

The first layer 20 formed with a method described above is extremely stable chemically, physically, and thermally. Therefore, in a step of forming the second layer 30 on the first layer 20, it is rare that the first layer 20 is corroded by the second coating solution such that the components of the first layer 20 are eluted or the components of the first layer 20 initiate an oxidation or decomposition reaction due to heating. Therefore, it is possible to form the second layer 30 evenly and stably on the first layer 20 by thermal decomposition. As a result, in the electrode for electrolysis 100, the adhesion of the conductive substrate 10, the first layer 20, and the second layer 30 is high, and an even catalyst layer (second layer 30) is formed.

EXAMPLES

The present invention will be described below in further detail based on examples. However, the present invention is not limited to these examples.

Example 1

A pretreatment was performed as follows. As a conductive substrate, an expanded substrate formed of titanium of which the larger dimension (LW) of an aperture is 6 mm, the smaller dimension (SW) of an aperture is 3 mm, and the plate thickness is 1.0 mm was used. An oxide coating was formed on the surface through baking of the expanded substrate for 3 hours at 550° C. in atmosphere. Then, an irregularity was provided to the substrate surface through blasting using steel grit of which the average particle diameter is 1 mm or less. Next, acid treatment was performed for 4 hours at 85° C. within sulfuric acid of 25 wt %, a fine irregularity was provided to the conductive substrate surface by removing a titanium oxide layer.

Next, titanium tetrachloride (produced by Kishida Chemical Co., Ltd.) was gradually added in small amounts to a ruthenium chloride solution (produced by Tanaka Kikinzoku K.K., 100 g/L ruthenium concentration) while cooling to 5° C. or lower with dry ice, and then further an iridium chloride solution (produced by Tanaka Kikinzoku K.K., 100 g/L iridium concentration) was gradually added in small amounts to prepare a coating solution A (first coating solution), such that the mole ratio of ruthenium, iridium, and titanium is 25:25:50 and the total metal concentration is 100 g/L.

The coating solution A is placed on a roller, a sponge roller formed of ethylene propylene diene (EPDM) is rotated to suck up the coating solution, and the conductive substrate subjected to the pretreatment described above is passed through in between with a roller formed of polyvinyl chloride (PVC) arranged to contact an upper portion of the sponge roller, thus the conductive substrate roll-coated with the coating solution A. Immediately after that, the conductive substrate was passed through between two sponge rollers formed of EPDM that are wrapped with cloth, and excess coating solution was wiped off. Then, after drying for 2 minutes at 75° C., baking was performed for 10 minutes at 475° C. in atmosphere. A step of a sequence of the roll coating, drying, and baking was performed repeatedly for a total of seven times, a final baking (post baking) was performed for 1 hour at 500° C., and a blackish-brown coating layer (first layer) with a thickness of about 2 μm was formed on an electrode substrate.

Next, a dinitrodiammine platinum nitrate aqueous solution (produced by Tanaka Kikinzoku K.K, 100 g/L platinum concentration) and a palladium nitrate aqueous solution (produced by Tanaka Kikinzoku K.K, 100 g/L palladium concentration) were mixed to prepare a coating solution B (second coating solution), such that the mole ratio of platinum and palladium is 4:1 and the total metal concentration is 100 g/L.

Roll coating with the coating solution B was done in the same manner to the coating solution A for the surface of the first layer formed on the conductive substrate, and excess coating solution B was wiped off. Subsequently, after drying for 2 minutes at 75° C., baking was performed for 10 minutes at 600° C. in atmosphere. A step of a sequence of application, drying, and baking of the coating solution B was performed repeatedly for a total of three times. In this manner, an electrode for electrolysis of Example 1 having a white coating (second layer) with a thickness of 0.1 to 0.2 μm further on the first layer was prepared.

Example 2

Chloroplatinic acid ($H_2PtCl_2 \cdot 6H_2O$) (produced by Tanaka Kikinzoku K.K, 100 g/L platinum concentration) and palladium chloride ($PdCl_2$) (produced by Tanaka Kikinzoku K.K, 100 g/L palladium concentration) were mixed to prepare a coating solution C, such that the mole ratio of platinum and palladium is 75:25 and the total metal concentration is 20 g/L. As a solvent, butyl alcohol was used. In Example 2, the coating solution C was used instead of the coating solution A as a second coating solution to form a second layer with a method described below.

The coating solution C was applied in the same manner to Example 1 to the surface of a first layer formed on a conductive substrate in the same manner to Example 1, and excess coating solution was wiped off. Subsequently, after drying for 2 minutes at 75° C., baking was done for 5 minutes at 550° C. in atmosphere. After a step of a sequence of application, drying, and baking of the coating solution C was repeatedly performed for a total of eight times, the step of the sequence was further performed for a total of two times with the time for baking changed to 30 minutes to form the second layer and prepare an electrode for electrolysis of Example 2.

Comparative Example 1

An electrode for electrolysis of Comparative Example 1 was prepared in the same manner to Example 1 except that application of the coating solution B was not performed and a second layer was not formed in the electrode for electrolysis.

Comparative Example 2

In Comparative Example 2, application of the coating solution A was not performed, and the coating solution B was applied directly to a conductive substrate to form a second layer. That is, an electrode for electrolysis of Comparative Example 2 was prepared in the same manner to Example 1 except that a first layer was not formed between the conductive substrate and the second layer.

Comparative Example 3

In Comparative Example 3, application of the coating solution A was not performed, and the coating solution C was applied directly to a conductive substrate to form a second layer. That is, an electrode for electrolysis of Comparative Example 3 was prepared in the same manner to Example 2 except that a first layer was not formed between the conductive substrate and the second layer.

Comparative Example 4

A dinitrodiammine platinum nitrate aqueous solution (produced by Tanaka Kikinzoku K.K, 100 g/L platinum concentration) and a palladium nitrate aqueous solution (produced by Tanaka Kikinzoku K.K, 100 g/L palladium concentration) were mixed to prepare a coating solution D, such that the mole ratio of platinum and palladium is 33:67 and the total metal concentration is 100 g/L.

An electrode for electrolysis of Comparative Example 4 was prepared in the same manner to Example 1 except that a coating solution D was used instead of the coating solution B.

The metal composition of the first layer and the second layer (metal composition of the coating solution used in forming the first layer and the second layer) of the electrode for electrolysis in the examples and comparative examples are shown in Table 1. The unit "%" in the table means mole percentage with respect to all of the metal atoms contained in each layer.

TABLE 1

| | Metal composition of first layer | | | Metal composition of second layer | |
|---|---|---|---|---|---|
| | Ir | Ru | Ti | Pd | Pt |
| Example 1 | 25% | 25% | 50% | 20% | 80% |
| Example 2 | 25% | 25% | 50% | 25% | 75% |
| Comprative Example 1 | 25% | 25% | 50% | — | |
| Comprative Example 2 | | — | | 20% | 80% |
| Comprative Example 3 | | — | | 25% | 75% |
| Comprative Example 4 | 25% | 25% | 50% | 67% | 33% |

Powder X-ray Diffraction Measurement

The electrode for electrolysis of each example and comparative example cut into a predetermined size was placed on a stage to perform a powder X-ray diffraction measurement. The Ultra X18 (produced by Rigaku Corporation) was used as a device for powder X-ray diffraction, and a CuKα radiation (λ=1.54184 Å) was used as a radiation source. Measurement was done with an acceleration voltage of 50 kV, an acceleration current of 200 mA, a scan axis of 2θ/θ, a step interval of 0.02°, and a scan speed of 2.0° per minute and in a range of 2θ=25 to 60°. The half width (full width at half maximum) was calculated with analysis software that comes with an X-ray diffraction device.

To check the presence or absence of metal palladium, metal platinum, and an alloy of platinum and palladium, changes in the intensity and peak position thereof were checked. The diffraction angle (2θ) corresponding to the diffraction line of metal palladium is 40.11° and 46.71°, and the diffraction angle (2θ) corresponding to the diffraction line of metal platinum is 39.76° and 46.29°. Regarding the alloy of platinum and palladium, it is known that the peak position shifts continuously in accordance with the alloy composition of platinum and palladium. Therefore, whether platinum and palladium are alloyed can be determined from whether there is a shift of the diffraction line of platinum metal to a high angle side.

Since a test electrode that is cut out is directly used for the X-ray diffraction measurement in this measurement, a diffraction line derived from metal (titanium in the example and comparative example) of the conductive substrate is detected with relatively high intensity. The diffraction angle (2θ) corresponding to the diffraction line of metal titanium is 40.17°, 35.09°, and 38.42°. Thus, the presence or absence of metal palladium, metal platinum, and the alloy of platinum and palladium was determined from a change in the intensity and peak position of each diffraction line on a wide angle side with 46.71° for metal palladium and 46.29° for metal platinum.

To check the mole ratio of palladium oxide with respect to the total amount of metal, the alloy composition of platinum and palladium was calculated. The alloy composition was calculated from the position of a peak of the alloy observed between 46.29° (metal platinum) and 46.71° (metal palladium). To accurately obtain the peak position, measurement was done with a step interval of 0.004°, a scan speed of 0.4° per minute and in a range of 2θ=38 to 48° as measurement conditions for the powder X-ray diffraction measurement. The percentage of palladium oxide was calculated from the alloy composition obtained from the peak position of alloy and the composition in the preparation of platinum and palladium.

Furthermore, to check the presence or absence of palladium oxide, the presence or absence of a diffraction line of 33.89° that is the diffraction angle (2θ) corresponding to the diffraction line of palladium oxide was checked.

To check whether or not there is oxidation of metal titanium, it serves well to check the presence or absence of a diffraction line of 27.50° or 36.10° that is the diffraction angle (2θ) corresponding to the diffraction line of titanium oxide. At this time, the diffraction angle (2θ) corresponding to the diffraction line of the first layer containing at least one oxide of ruthenium, iridium, and titanium is 27.70°, and the proximity to the diffraction line of titanium oxide formed through oxidation of the conductive substrate needs to be noted. The diffraction angles the respective metals are given in Table 2.

TABLE 2

| Metal composition | | Diffraction angle | |
|---|---|---|---|
| Palladium | Pd | 40.11° | 46.71° |
| Platinum | Pt | 39.76° | 46.29° |

TABLE 2-continued

| Metal composition | | Diffraction angle | | |
|---|---|---|---|---|
| Titanium | Ti | 40.17° | 35.09° | 38.42° |
| Palladium oxide | PdO | 33.89° | | |
| Titanium oxide | $TiO_2$ | 27.50° | 36.10° | |
| First layer | $IrO_2$, $RuO_2$, $TiO_2$ | 27.70 | | |

Figure 2:
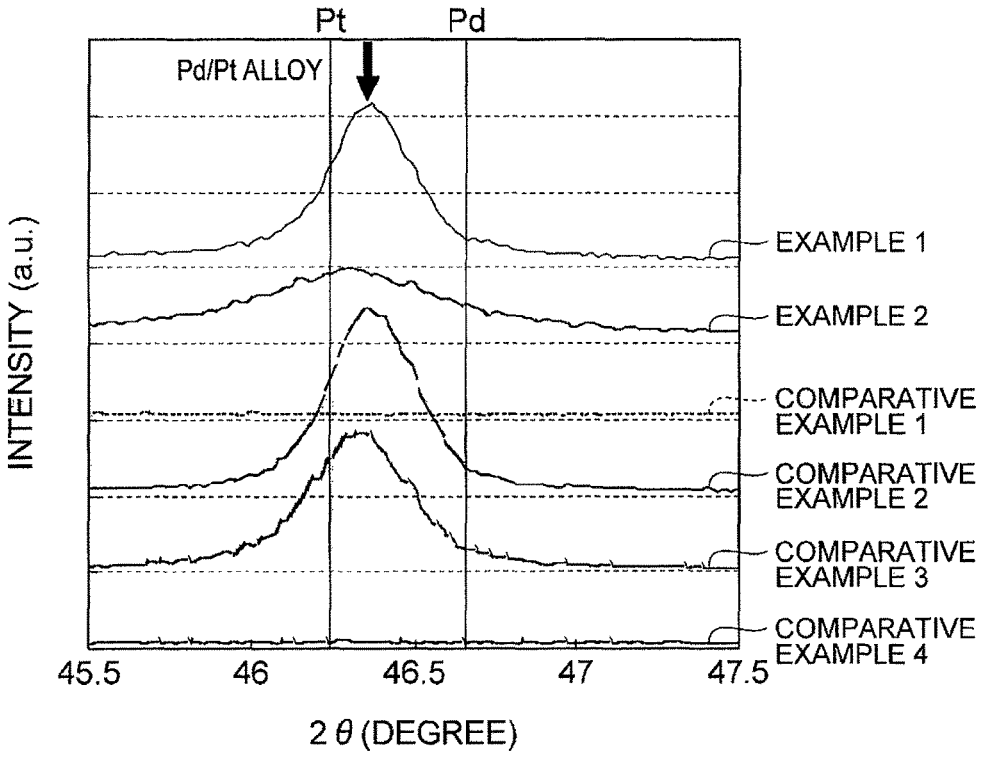
FIG. 2 is a partial enlarged view of a graph (diffraction pattern) of the powder X-ray diffraction measurement result for the electrode for electrolysis of each example and comparative example.
Figure 3:
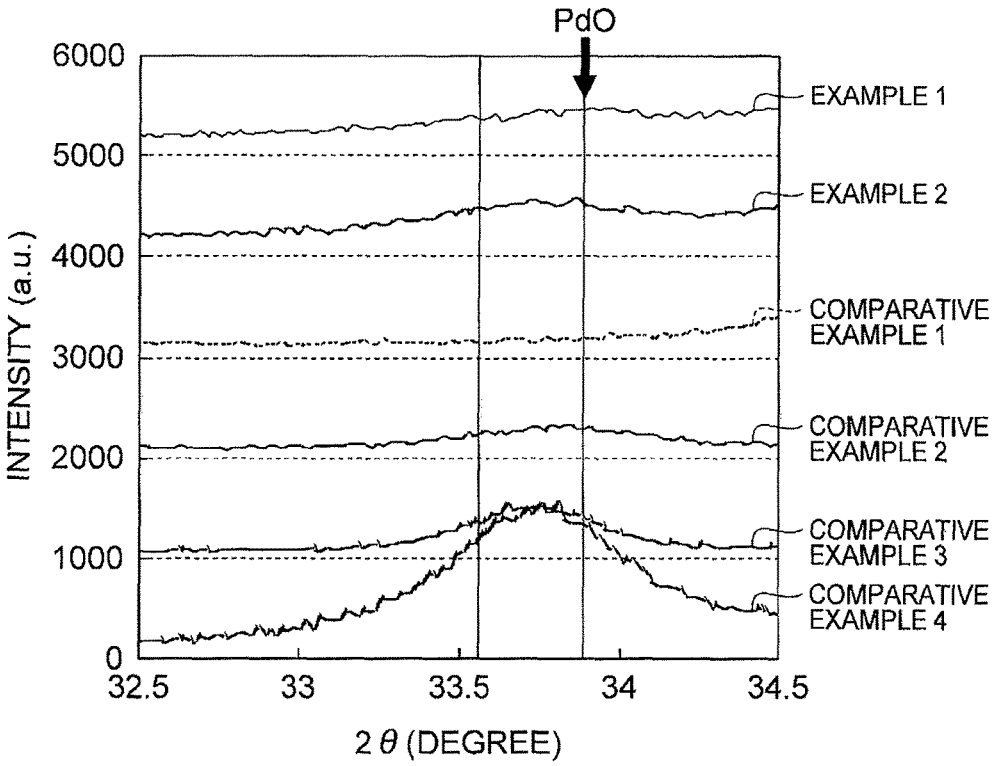
FIG. 3 is a partial enlarged view of a graph (diffraction pattern) of the powder X-ray diffraction measurement result for the electrode for electrolysis of each example and comparative example.

The results of the powder X-ray diffraction measurement are shown in FIG. 1 to FIG. 3. Table 3 lists the percentages of the alloy composition of the electrode for electrolysis of the examples and comparative examples calculated from the position of the peak of the alloy of platinum and palladium and the percentages of an alloy component and oxide component of platinum and palladium. Note that, in Table 3, the percentage of Pt (platinum) and Pd (palladium) shown as the alloy composition represents, with an alloy of platinum and palladium present in the second layer of the electrode for electrolysis as a reference, the mole percentage of each of platinum and palladium contained in the alloy. The percentage of Pt (alloy) shown as the metal composition represents the mole percentage of platinum forming the alloy, with the total amount of Pt atoms and Pd atoms present in the second layer of the electrode for electrolysis as a reference. In a similar manner, the percentage of Pd (alloy) shown as the metal composition represents the mole percentage of palladium forming the alloy, with the total amount of Pt atoms and Pd atoms present in the second layer of the electrode for electrolysis as a reference. The percentage of Pt (oxide) shown as the metal composition represents the mole percentage of platinum forming an oxide, with the total amount of Pt atoms and Pd atoms present in the second layer of the electrode for electrolysis as a reference. In a similar manner, the percentage of Pd (oxide) shown as the metal composition represents the mole percentage of palladium forming an oxide, with the total amount of Pt atoms and Pd atoms present in the second layer of the electrode for electrolysis as a reference.

TABLE 3

| | Pd—Pt alloy, peak position | Pd—Pt alloy. peak half width | Alloy composition Pt | Alloy composition Pd | Metal composition Pt (alloy) | Metal composition Pd (alloy) | Metal composition Pt (oxide) | Metal composition Pd (oxide) |
|---|---|---|---|---|---|---|---|---|
| Example 1 | 46.362° | 0.33° | 82% | 18% | 80% | 17% | — | 3% |
| Example 2 | 46.320° | 0.78° | 92% | 8% | 75% | 6% | — | 19% |
| Comprative Example 1 | — | — | — | — | — | — | — | — |
| Comprative Example 2 | 46.364° | 0.32° | 82% | 18% | 80% | 18% | — | 2% |
| Comprative Example 3 | 46.335° | 0.37° | 89% | 11% | 75% | 10% | — | 15% |
| Comprative Example 4 | — | — | — | — | — | — | 33% | 67% |

With the electrode of Example 1, a peak was observed at 46.36° (see FIG. 2). This peak is attributed to the main diffraction line of the alloy of platinum and palladium. While a peak attributed to palladium oxide (PdO) was observed at 33.89° (see FIG. 3), it has been found from the peak intensity in comparison with the alloy of platinum and palladium that the formation of palladium oxide is suppressed. While a peak attributed to the first layer formed from ruthenium oxide, iridium oxide, and titanium oxide was observed at 27.70° (see FIG. 1), a diffraction peak attributed to oxidation of a titanium substrate was less detected, and a change from the diffraction pattern of the first layer alone of the electrode for electrolysis of Comparative Example 1 was absent. Accordingly, it has been found that there is little oxidation of the titanium substrate.

Since the half width at 46.36° for the alloy of platinum and palladium in the electrode for electrolysis of Example 1 is small at 0.33°, it has been found that an alloy of platinum and palladium of which the crystallite size is large and the crystallinity is high is formed. With the alloy composition being calculated to be Pt:Pd=82:18 from the peak position of alloy, Pt (metal):Pd (metal):Pd (oxide)=80:17:3 has been found through calculation in consideration of the diffraction intensity of palladium oxide.

While a peak of the alloy of platinum and palladium was detected in the same manner to the electrode for electrolysis of Example 1 with the electrode for electrolysis of Example 2, the half width of a peak of alloy is 0.78° and greater than in Example 1, and it has been found that an alloy of platinum and palladium of which the crystallite size is smaller and crystallinity is lower compared to Example 1 is formed. The alloy composition was calculated to be Pt:Pd=92:8 from the peak position of alloy, and it has been found that Pt (metal):Pd (metal):Pd (oxide)=75:6:19 and palladium oxide is generated a lot.

With the electrode for electrolysis of Comparative Example 1, a solid solution of ruthenium oxide ($RuO_2$), iridium oxide ($IrO_2$), and titanium oxide ($TiO_2$) was formed, and it has been found that a diffraction pattern similar to the electrode for electrolysis of Example 1 is shown except that a diffraction line corresponding to the second layer is absent.

With the electrode of Comparative Example 2, a peak was detected at 46.36° (see FIG. 2) in the same manner to the electrode for electrolysis of Example 1 and was attributed to the main diffraction line of the alloy of platinum and palladium. The half width at the peak of the alloy of platinum and palladium was small at 0.32°. The alloy composition was calculated to be Pt:Pd=82:18 from the peak position of alloy, and it has been found that Pt (metal):Pd (metal):Pd (oxide)=80:18:2 and the amount of palladium oxide is small. Note that the presence of titanium oxide ($TiO_2$) was confirmed at 27.50° and 36.10°, and it has been found that the titanium substrate is oxidized.

While a peak of palladium oxide and the alloy of platinum and palladium was observed in the same manner to the electrode for electrolysis of Example 1 with the electrode for electrolysis of Comparative Example 3, it has been found that palladium oxide (PdO) is formed a lot from comparison with the peak intensity of palladium oxide and alloy. The alloy composition was calculated to be Pt:Pd=89:11 from the peak position of alloy, and it has been found that Pt (metal):Pd (metal):Pd (oxide)=75:10:15 and palladium oxide is generated a lot. Furthermore, the presence of titanium oxide ($TiO_2$) was also confirmed.

With the electrode for electrolysis of Comparative Example 4, palladium oxide (PdO) was formed a lot, and a peak attributed to the alloy of platinum and palladium was not observed. In Comparative Example 4, a solid solution in which platinum is incorporated into palladium oxide is formed, and it is clear from the fact that a diffraction peak appears at 33.77° and is shifted to a low angle side from the diffraction angle (33.89° of palladium oxide.

Ion-exchange Membrane Method Brine Electrolysis Test

An electrode for electrolysis was cut out to a size (95×110 mm=1.045 $dm^2$) of an electrolytic cell and attached to an anode cell by welding. For a cathode, a metal mesh substrate formed of nickel on which a coating of ruthenium oxide is formed was used. A cathode cell was prepared by welding an expanded substrate formed of nickel not subjected to coating onto a cathode rib, putting a cushion mattress woven with a wire formed thereon, and arranging the cathode thereon. Electrolysis was performed in a state where an ion-exchange membrane is sandwiched between an anode cell and the cathode cell using a rubber gasket formed of EPDM. As the ion-exchange membrane, Aciplex (registered trademark) F6801 (produced by Asahi Kasei Chemicals) that is a cation-exchange membrane for brine electrolysis was used.

To measure the chlorine overvoltage (anode overvoltage), platinum wire coated with a PFA (copolymer of tetrafluoroethylene and perfluoroalkyl vinyl ether) in which about 1 mm of a platinum portion was exposed was tied with a Teflon (registered trademark) thread and fixed in front of the surface of a test electrode (electrode for electrolysis under test) on a side of which the ion-exchange membrane was not present and was used as a reference electrode. During the electrolysis test, the potential of the reference electrode becomes a chlorine evolution potential due to atmosphere saturated with generated chlorine gas. The potential of the test electrode minus the potential of the reference electrode is regarded as the anode overvoltage. The pair voltage (electrolysis voltage) is the potential difference between the cathode and the anode (test electrode).

The electrolysis conditions were a current density of 6 $kA/m^2$, a brine concentration of 205 g/L within the anode cell, a NaOH concentration of 32 wt % within the cathode cell, and a temperature of 90° C. For a rectifier for electrolysis, PAD36-100LA (product name, produced by Kikusui Electronics Corp.) was used.

The results of the ion-exchange membrane method brine electrolysis test are shown in Table 4.

TABLE 4

| | Electrolysis voltage 6 $kA/m^2$ | Anode overvoltage 6 $kA/m^2$ |
|---|---|---|
| Example 1 | 2.91 V | 0.034 V |
| Comprative Example 1 | 2.99 V | 0.046 V |
| Comprative Example 2 | 2.92 V | 0.040 V |
| Comprative Example 3 | 2.93 V | 0.034 V |
| Comprative Example 4 | 2.92 V | 0.032 V |

With the electrode for electrolysis of Example 1 and Comparative Examples 2 to 4, the electrolysis voltage at a current density of 6 $kA/m^2$ was 2.91 to 2.93 V, the anode overvoltage was 0.032 to 0.040 V, showing a lower value in comparison with the electrolysis voltage (2.99 V) and the anode overvoltage (0.046 V) of the electrode for electrolysis of Comparative Example 1.

Shutdown Test

An electrolytic cell that is similar to that for the ion-exchange membrane method brine electrolysis test described above except that the size of the electrolytic cell (50×37 mm=0.185 $dm^2$) was used.

The electrolysis conditions were a current density of 10 $kA/m^2$, a brine concentration of 205 g/L within the anode cell, a NaOH concentration of 32 wt % within the cathode cell, and a temperature of 95° C. To confirm the durability of a test electrode (electrode for electrolysis of each example and comparative example), an operation of a sequence of stopping electrolysis, washing (for 10 minutes) inside the electrolytic cell with water, and starting electrolysis was performed once every two days, and the chlorine overvoltage (anode overvoltage) and the residual rate of a second layer of the test electrode were measured every 10 days after the start of electrolysis. The second layer of the test electrode was measured by an X-ray fluorescence measurement (XRF) of platinum and palladium, and the residual rate of a metal component before and after electrolysis was calculated. Note that, for an XRF measurement device, Niton XL3t-800 (product name, produced by Thermo Scientific Inc.) was used.

The results of the shutdown test are shown in Table 5. The "Pt/Pd metal depletion weight" in the table is a total value of the weight of Pt and Pd eluted from the second layer of each electrode for electrolysis during electrolysis. A small "Pt/Pd metal depletion weight" means a high residual rate of metal component.

TABLE 5

| | Anode overvoltage 10 $kA/m^2$ | | | Pt/Pd metal depletion weight | |
|---|---|---|---|---|---|
| | 0th day | 20th day | 40th day | 20th day | 40th day |
| Example 1 | 28 mV | 29 mV | 30 mV | 0.20 $g/m^2$ | 0.53 $g/m^2$ |
| Example 2 | 31 mV | 30 mV | 35 mV | 0.25 $g/m^2$ | 0.71 $g/m^2$ |
| Comprative Example 1 | 53 mV | 51 mV | 50 mV | — | — |
| Comprative Example 2 | 34 mV | 40 mV | * | 0.19 $g/m^2$ | * |
| Comprative Example 3 | 28 mV | 51 mV | * | 0.26 $g/m^2$ | * |
| Comprative Example 4 | 28 mV | 28 mV | 30 mV | 1.50 $g/m^2$ | 2.30 $g/m^2$ |

* Evaluation aborted after 20 days due to voltage rise during electrolysis evaluation The shutdown test was performed for 40 days, and the electrode for electrolysis of Examples 1 and 2 and Comparative Examples 1 and 4 showed an approximately constant anode overvoltage even after 40 days of evaluation. With the electrode for electrolysis of Examples 1 and 2 and Comparative Example 4, the anode overvoltage was about 30 mV that is lower in comparison with 51 mV of anode overvoltage in Comparative Example 1, and a low overvoltage effect due to the second layer of the electrode for electrolysis was observed. With the electrode for electrolysis of Comparative Examples 2 and 3, however, evaluation was aborted since the overvoltage rose on the 20th day of evaluation, although the anode overvoltage at the time of the start of evaluation was low (see Table 5). The rise in overvoltage was presumably caused because the titanium substrate was rapidly oxidized without protection, since the electrode has no first layer.

As a result of measuring the weight decrease amount of platinum and palladium, it has been found that the catalyst is rapidly lost in the electrode for electrolysis of Comparative Example 4. This is presumably caused because palladium oxide highly present in the electrode for electrolysis of Comparative Example 4 is reduced by the shutdown operation to become metal palladium, reacts with a chloride ion ($Cl^-$) within brine, and is eluted as $PdCl_4^{2-}$. Through comparison with the electrode for electrolysis of Examples 1 and 2, it was made clear that the electrode for electrolysis of Example 1 is higher in durability of the catalyst layer (second layer).

Measurement of Oxygen Gas Concentration within Chlorine Gas

In the ion-exchange membrane method brine electrolysis test described above, chlorine gas evolved on the test electrode side was caused to be absorbed into 3.5 liters of a 17% NaOH aqueous solution for 1 hour during operation with a current density of 6 kA/$m^2$, a brine concentration of 205 g/L within the anode cell, a NaOH concentration of 32 wt % within the cathode cell, and a temperature of 90° C., and the chlorine gas amount obtained from a chemical titration method shown below and the oxygen gas amount obtained from an analysis with a gas chromatography method for remaining gas were compared to calculate the oxygen gas concentration within chlorine gas.

When chlorine gas was blown into a NaOH aqueous solution, NaClO was generated. By adding KI and acid of a certain amount to this, the solution was acidized to release $I_2$. Furthermore, after adding an indicator such as dextrin, the quantity of the chlorine gas evolution amount was determined by titrating $I_2$ released in an aqueous solution of $Na_2S_2O_3$ of which the concentration was specified.

A part of remaining gas after chlorine gas was absorbed was sampled with a microsyringe and shot into a gas chromatography device, and the composition ratio of oxygen, nitrogen, and hydrogen was obtained. Then, the oxygen gas concentration within chlorine gas was obtained from the chlorine gas evolution amount and the volume ratio of remaining gas. For the gas chromatography device, GC-8A (with thermal conductivity detector, produced by Shimadzu Corporation) was used. Molecular sieves 5A was used for a column, and helium for carrier gas.

Regarding brine supplied to the anode side during electrolysis, measurement was performed for a case without the addition of hydrochloric acid and for a case where hydrochloric acid was added such that the pH within the cell became 2.

The measurement results for the oxygen gas concentration within chlorine gas are shown in Table 6. Within the table, "%" represents "vol %."

TABLE 6

| | Oxygen concentration within chlorine (HCl not added) | Oxygen concentration within chlorine (HCl added, PH = 2) |
|---|---|---|
| Example 1 | 0.32% | 0.21% |
| Comprative Example 1 | 0.75% | 0.35% |

The oxygen gas concentration within chlorine gas evolved at the electrode for electrolysis of Example 1 was 0.32% when hydrochloric acid was not added and was found to be lower compared to 0.75% for the electrode for electrolysis of Comparative Example 1. The oxygen gas concentration within chlorine gas evolved at the electrode for electrolysis of Example 1 was lower compared to the electrode for electrolysis of Comparative Example 1 also when hydrochloric acid was added.

Organic Substance Tolerance Test

In the ion-exchange membrane brine electrolysis test, an organic substance was added within brine supplied to the anode chamber, and the influence on the anode overvoltage and the electrolysis voltage for the test electrode was observed. For the organic substance, sodium acetate was used. Brine was prepared such that TOC (total organic carbon) was 20 ppm and supplied to the anode chamber. After 24 hours of electrolysis with a current density of 6 kA/$m^2$, a brine concentration of 205 g/L within the anode cell, a NaOH concentration of 32 wt % within the cathode cell, and a temperature of 90° C. and stabilized, the anode overvoltage and the electrolysis voltage were observed. Note that, in the ion-exchange membrane method brine electrolysis test described above in which an organic substance was not added, the TOC concentration within brine was 5 ppm or less.

The results of the organic substance tolerance test are shown in Table 7.

TABLE 7

| | When sodium acetate is not added TOC = 5 ppm | | When sodium acetate is added TOC = 20 ppm | |
|---|---|---|---|---|
| | Electrolysis voltage 6 kA/$m^2$ | Anode overvoltage 6 kA/$m^2$ | Electrolysis voltage 6 kA/$m^2$ | Anode overvoltage 6 kA/$m^2$ |
| Example 1 | 2.93 V | 0.032 V | 2.93 V | 0.032 V |
| Comprative Example 1 | 2.98 V | 0.045 V | 3.01 V | 0.055 V |
| Comprative Example 2 | 2.93 V | 0.034 V | 2.93 V | 0.035 V |

A change in the electrolysis voltage and the chlorine overvoltage (anode overvoltage) depending on the presence or absence of addition of the organic substance was not recognized with the electrode of Example 1, whereas a rise of 0.03 V in the electrolysis electrolysis voltage when the organic substance was added was recognized with the electrode for electrolysis of Comparative Example 1.

Examples 3 to 6

In Examples 3 to 5, a coating solution containing platinum and palladium in a ratio described in the column of "Metal composition of second layer" in Table 8 was used instead of the coating solution B of Example 1. That is, each electrode for electrolysis of Examples 3 to 5 was prepared in the same manner to Example 1 except for the composition of the coating solution B.

In Example 6, a coating solution containing ruthenium, iridium, and titanium in a ratio described in the column of "Metal composition of first layer" in Table 8 was used instead of the coating solution A of Example 1. That is, each electrode for electrolysis of Example 6 was prepared in the same manner to Example 1 except for the composition of the coating solution A.

Figure 6:
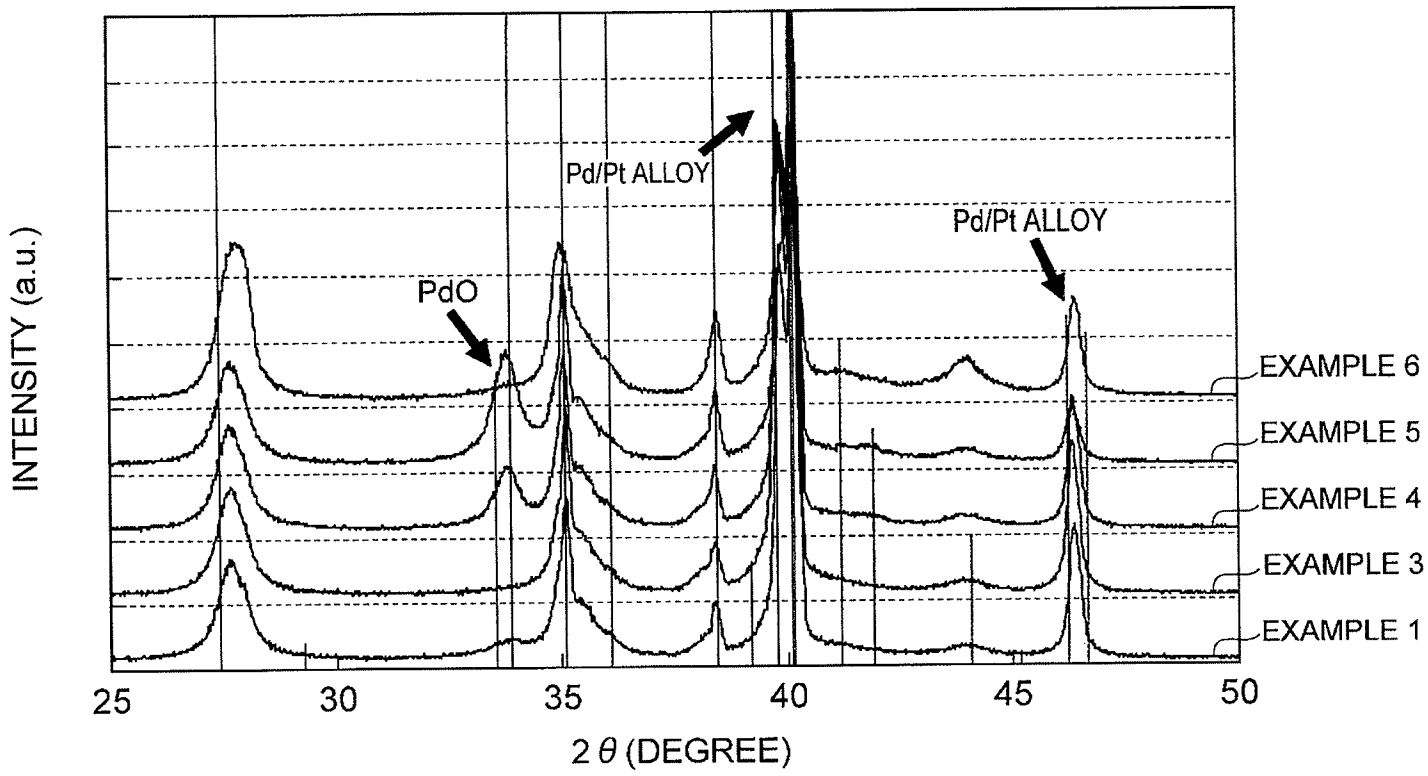
FIG. 6 is a graph (diffraction pattern) of a powder X-ray diffraction measurement result for an electrode for electrolysis of each example.
Figure 7:
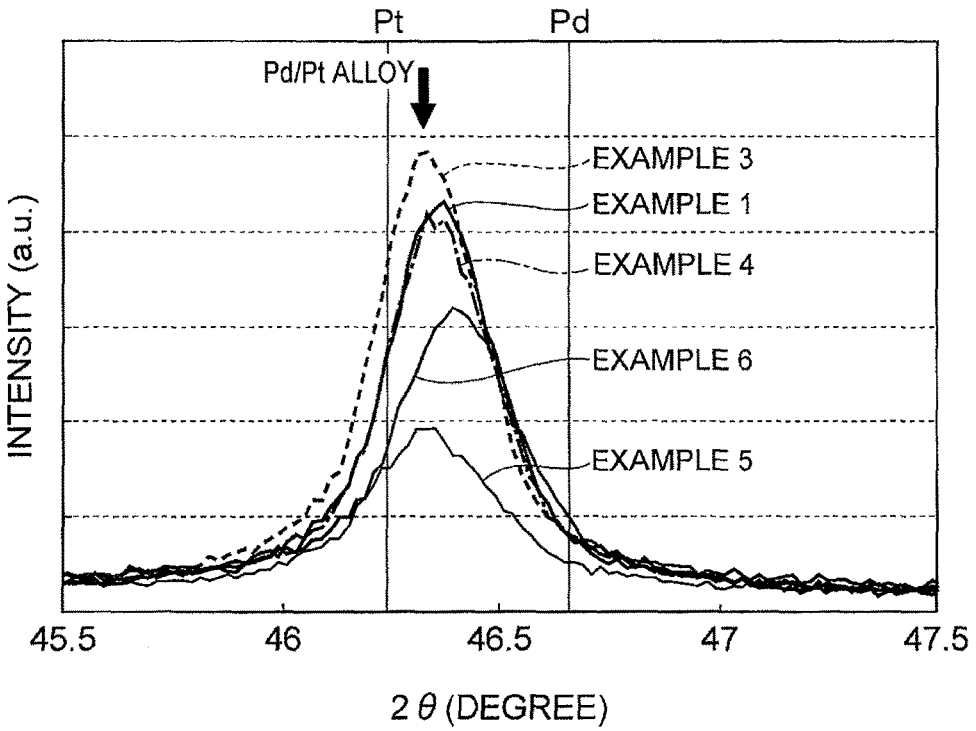
FIG. 7 is a partial enlarged view of a graph (diffraction pattern) of the powder X-ray diffraction measurement result for the electrode for electrolysis of each example.

With a method similar to Example 1, each electrode for electrolysis of Examples 3 to 6 was analyzed by powder X-ray diffraction. The analysis results of Examples 3 to 6 are shown in Table 8. In FIG. 6 and FIG. 7, a graph (diffraction pattern) of a powder X-ray diffraction measurement result for each electrode for electrolysis obtained in Example 1 and Examples 3 to 6 and a partial enlarged view thereof are shown.

TABLE 8

| | Metal composition of first layer | | | Metal composition of second layer | | Pd—Pt alloy, peak position | Pd—Pt alloy, peak half width | Alloy composition | | Metal composition | | | |
|---|---|---|---|---|---|---|---|---|---|---|---|---|---|
| | Ir | Ru | Ti | Pd | Pt | | | Pt | Pd | Pt (alloy) | Pd (alloy) | Pt (oxide) | Pd (oxide) |
| Example 1 | 25% | 25% | 50% | 20% | 80% | 46.362° | 0.33° | 82% | 18% | 80% | 17% | — | 3% |
| Example 3 | 25% | 25% | 50% | 10% | 90% | 46.328° | 0.32° | 90% | 10% | 90% | 9.5% | — | 0.5% |
| Example 4 | 25% | 25% | 50% | 30% | 70% | 46.339° | 0.31° | 88% | 12% | 70% | 10% | — | 20% |
| Example 5 | 25% | 25% | 50% | 40% | 60% | 46.323° | 0.4° | 92% | 8% | 60% | 6% | — | 35% |
| Example 6 | 20% | 35% | 45% | 20% | 80% | 46.41° | 0.36° | 80% | 20% | 80% | 20% | — | 0 |

In all of the respective electrodes of Examples 3 to 6, an alloy of palladium and platinum was observed. Since the half width of a diffraction peak of each Pd—Pt alloy is small, it has been found that an alloy of high crystallinity is obtained within the electrode of each example.

Examples 7 to 11

In Examples 7 and 8, the baking temperature (temperature of thermal decomposition upon forming the second layer) of the coating solution B applied to the surfaces of the first layers was set to a temperature shown in Table 9 shown below. Furthermore, in Examples 9 to 11, a postheating process was further performed with respect to the second layers formed by baking. The temperature and time for the postheating process of Examples 9 to 11 are shown in Table 9 shown below. Except for these, each electrode for electrolysis of Examples 9 to 11 was prepared in the same manner to Example 1.

Figure 8:
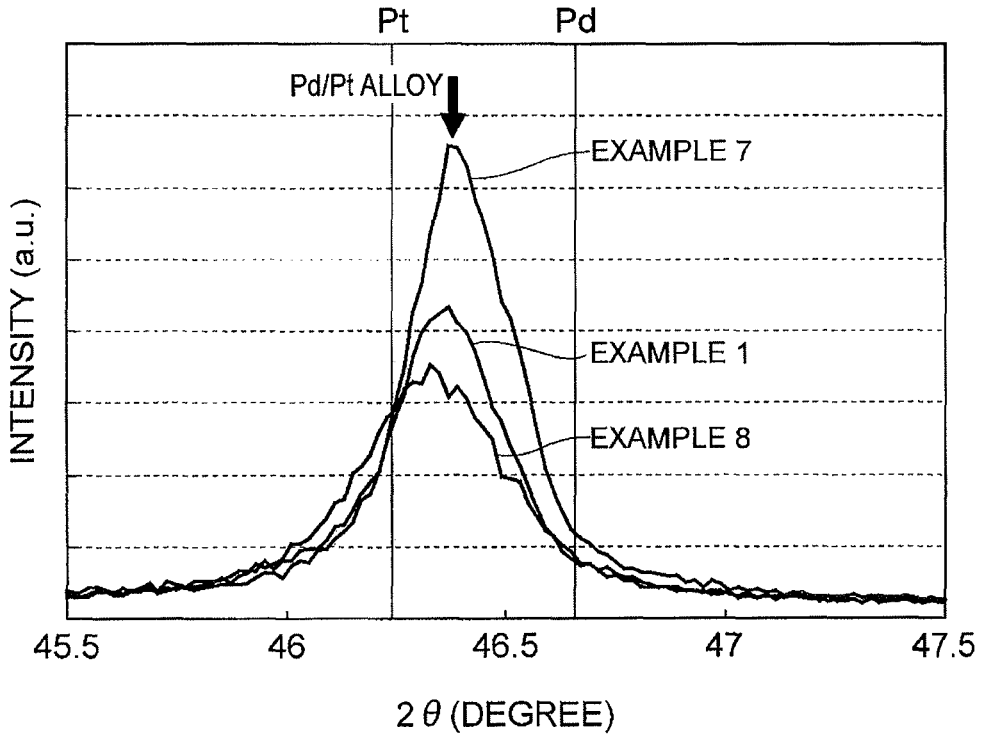
FIG. 8 is a partial enlarged view of a graph (diffraction pattern) of a powder X-ray diffraction measurement result for an electrode for electrolysis of each example.

With a method similar to Example 1, each electrode for electrolysis of Examples 7 to 11 was analyzed by powder X-ray diffraction. The analysis results of Examples 7 to 11 are shown in Table 9. In FIG. 8, a partial enlarged view of a graph (diffraction pattern) of a powder X-ray diffraction measurement result for each electrode for electrolysis obtained in Examples 1, 7, and 8 is shown. Furthermore, in FIG. 9, a partial enlarged view of a graph (diffraction pattern) of a powder X-ray diffraction measurement result for each electrode for electrolysis obtained in Examples 9 to 11 is shown.

TABLE 9

| | Second layer, baking temperature | Postheating | | Pd—Pt alloy, peak position | Pd—Pt alloy, peak half width | Alloy composition | | Metal composition | | | |
|---|---|---|---|---|---|---|---|---|---|---|---|
| | | Temperature | Time | | | Pt | Pd | Pt (alloy) | Pd (alloy) | Pt (oxide) | Pd (oxide) |
| Example 1 | 600° C. | — | | 46.362° | 0.33° | 82% | 18% | 80% | 17% | — | 3% |
| Example 7 | 650° C. | — | | 46.406° | 0.29° | 80% | 20% | 80% | 20% | — | 0% |
| Example 8 | 550° C. | — | | 46.322° | 0.45° | 92% | 8% | 80% | 7% | — | 13% |
| Example 9 | 475° C. | 600° C. | 10 minutes | 46.34° | 0.45° | 88% | 12% | 80% | 11% | — | 9% |
| Example 10 | 475° C. | 600° C. | 30 minutes | 46.359° | 0.34° | 83% | 17% | 80% | 16% | — | 4% |
| Example 11 | 475° C. | 600° C. | 60 minutes | 46.349° | 0.32° | 85% | 15% | 80% | 14% | — | 6% |

In Examples 7 and 8, the baking temperature (temperature of thermal decomposition upon forming the second layer) of the coating solution B applied to the surfaces of the first layers was set to a temperature shown in Table 9 shown below. Except for this, each electrode for electrolysis of Examples 7 and 8 was prepared in the same manner to Example 1.

In Examples 9 to 11, the baking temperature (temperature of thermal decomposition upon forming the second layer) of In all of the respective electrodes of Examples 7 to 11, an alloy of palladium and platinum was observed. Since the half width of a diffraction peak of each Pd—Pt alloy is small, it has been found that an alloy of high crystallinity is obtained within the electrode of each example.

Through comparison of Examples 1, 7, and 8, it has been found that the half width of the diffraction peak of Pd—Pt alloy decreases as the thermal decomposition temperature upon forming the second layer increases (see FIG. 8).

Figure 9:
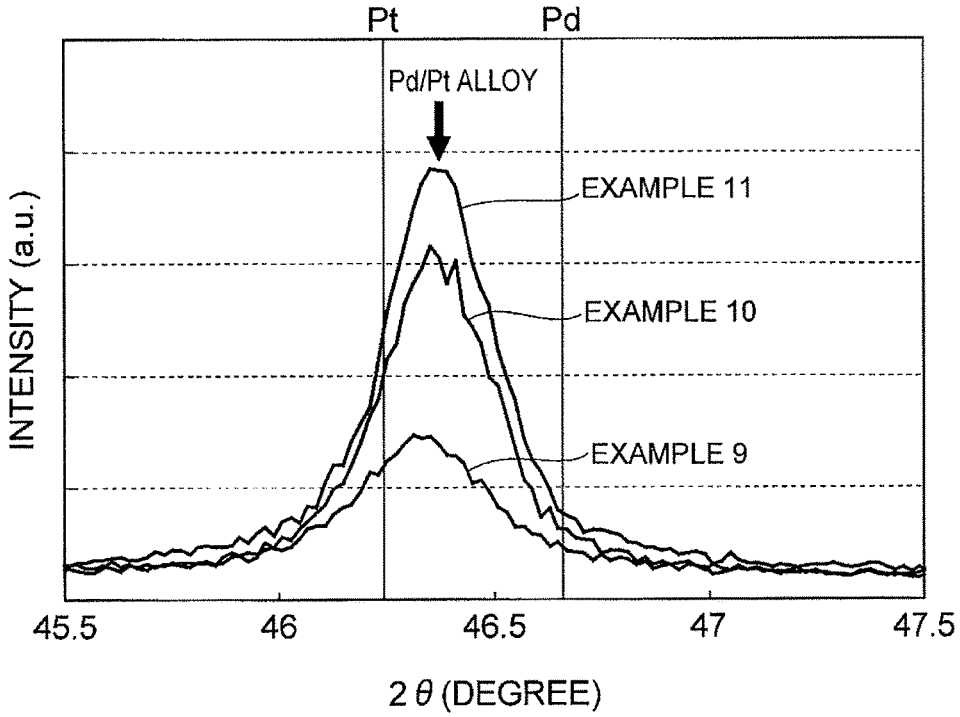
FIG. 9 is a partial enlarged view of a graph (diffraction pattern) of a powder X-ray diffraction measurement result for an electrode for electrolysis of each example.

Through comparison of Examples 9 to 11, it has been found that the half width of a diffraction peak of Pd—Pt alloy decreases as the time in which the postheating process is performed increases (see FIG. 9).

Next, with a method similar to Example 1 described above, a shutdown test using each electrode for electrolysis of Examples 1, 2, 3, 6, 7, 10, and 11 was performed. The results of Pd/Pt metal depletion weight on the 10th day are shown in Table 10.

TABLE 10

| | Pd—Pt alloy Peak half width | Pd/Pt metal depetion amount 10th day ($g/m_2$) |
|---|---|---|
| Example 1 | 0.33° | 0.10 |
| Example 2 | 0.78° | 0.21 |
| Example 3 | 0.32° | 0.10 |
| Example 6 | 0.36° | 0.16 |
| Example 7 | 0.29° | 0.08 |
| Example 10 | 0.34° | 0.14 |
| Example 11 | 0.32° | 0.11 |

From Table 10, it has been found that the durability of the second layer is higher when the half width of the diffraction peak of the peak of Pd—Pt alloy contained in the second layer of the electrode for electrolysis is smaller.

INDUSTRIAL APPLICABILITY

An electrode for electrolysis of the present invention shows low overvoltage and has excellent shutdown durability, is therefore useful as an anode for a brine electrolysis, particularly an anode for ion-exchange membrane method brine electrolysis, and enables chlorine gas of high purity in which the oxygen gas concentration is low to be produced over a long time.

REFERENCE SIGNS LIST

10 . . . Conductive substrate, 20 . . . First layer, 30 . . . Second layer, 100 . . . Electrode for electrolysis, 200 . . . Electrolyzation electrolytic cell, 210 . . . Electrolyte, 220 . . . Container, 230 . . . Anode (electrode for electrolysis), 240 . . . Cathode, 250 . . . Ion-exchange membrane, 260 . . . Wire

The invention claimed is:

1. An electrode for electrolysis comprising:
a conductive substrate;
a first layer formed on the conductive substrate; and
a second layer formed on the first layer,
wherein the first layer contains at least one oxide selected from the group consisting of ruthenium oxide, iridium oxide, and titanium oxide, and
the second layer contains
an alloy of platinum and palladium, and
palladium oxide,
wherein a mole percentage of palladium atoms forming an oxide is 13% or less of the total amount of platinum and palladium atoms in the second layer; and
wherein in the second layer, the mole percentage of palladium atoms forming an oxide to the total amount of palladium atoms is 20% or less;
wherein a half width of a diffraction peak of the alloy of which a diffraction angle is 46.29° to 46.71° in a powder X-ray diffraction pattern is 0.5° or less, and
wherein a content of platinum element contained in the second layer is greater than 4 mol and less than 10 mol with respect to 1 mol of palladium element contained in the second layer.

2. The electrode for electrolysis according to claim 1, wherein the first layer contains ruthenium oxide, iridium oxide, and titanium oxide.

3. The electrode for electrolysis according to claim 2, wherein the content of iridium oxide contained in the first layer is ⅕ to 3 mol with respect to 1 mol of ruthenium oxide contained in the first layer, and
the content of titanium oxide contained in the first layer is ⅓ to 8 mol with respect to 1 mol of ruthenium oxide contained in the first layer.

4. An electrolytic cell comprising the electrode for electrolysis according to claim 1.

5. An electrode for electrolysis comprising:
a conductive substrate;
a first layer formed on the conductive substrate; and
a second layer formed on the first layer,
wherein the first layer contains at least one oxide selected from the group consisting of ruthenium oxide, iridium oxide, and titanium oxide, and
the second layer contains
an alloy of platinum and palladium, and
palladium oxide,
wherein a mole percentage of palladium atoms forming an oxide is 13% or less of the total amount of platinum and palladium atoms in the second layer; and
wherein in the second layer, the mole percentage of palladium atoms forming an oxide to the total amount of palladium atoms is 5% to 20%;
wherein a half width of a diffraction peak of the alloy of which a diffraction angle is 46.29° to 46.71° in a powder X-ray diffraction pattern is 0.5° or less, and
wherein a content of platinum element contained in the second layer is greater than 4 mol and less than 10 mol with respect to 1 mol of palladium element contained in the second layer.

6. The electrode for electrolysis according to claim 5, wherein the first layer contains ruthenium oxide, iridium oxide, and titanium oxide.

7. The electrode for electrolysis according to claim 6, wherein the content of iridium oxide contained in the first layer is ⅕ to 3 mol with respect to 1 mol of ruthenium oxide contained in the first layer, and
the content of titanium oxide contained in the first layer is ⅓ to 8 mol with respect to 1 mol of ruthenium oxide contained in the first layer.

8. An electrolytic cell comprising the electrode for electrolysis according to claim 5.

9. The electrode for electrolysis according to claim 1, wherein the content of iridium oxide contained in the first layer is ⅕ to 3 mol with respect to 1 mol of ruthenium oxide contained in the first layer.

10. The electrode for electrolysis according to claim 1, the content of titanium oxide contained in the first layer is ⅓ to 8 mol with respect to 1 mol of ruthenium oxide contained in the first layer.

11. The electrode for electrolysis according to claim 1,
wherein in the second layer, the mole percentage of palladium atoms forming an oxide to the total amount of palladium atoms is 5% or less.

12. The electrode for electrolysis according to claim 1,
wherein in the second layer, the mole percentage of palladium atoms forming an oxide to the total amount of palladium atoms is 20%.

13. The electrode for electrolysis according to claim 1,
wherein in the second layer, the mole percentage of palladium atoms forming an oxide to the total amount of palladium atoms is 15%.

14. The electrode for electrolysis according to claim 1, wherein in the second layer, the mole percentage of palladium atoms forming an oxide to the total amount of palladium atoms is 5%.

* * * * *